US005822805A

United States Patent [19]

Lachman et al.

[11] Patent Number: 5,822,805

[45] Date of Patent: Oct. 20, 1998

[54] TOILET FLUSH ACTUATOR

[76] Inventors: Leigh J. Lachman, 17 Stratford Dr.; Klaus P. Stoffel, 41 Cornell Dr., both of Livingston, N.J. 07039

[21] Appl. No.: 679,735

[22] Filed: Jul. 12, 1996

[51] Int. Cl.[6] ..... E03D 5/00

[52] U.S. Cl. ..... 4/249

[58] Field of Search ..... 4/249, 250, 405, 4/411

[56] References Cited

U.S. PATENT DOCUMENTS

| | | | |
|---|---|---|---|
| 1,595,741 | 8/1926 | Sweeney | 4/250 |
| 2,679,651 | 6/1954 | Pokorny | 4/411 |
| 2,862,212 | 12/1958 | Holl | 4/249 |
| 3,032,778 | 5/1962 | Magos et al. | 4/249 |
| 3,883,904 | 5/1975 | Wittman | 4/249 |
| 4,562,601 | 1/1986 | Aflitto | 4/249 |
| 4,847,924 | 7/1989 | Samaniego | 4/249 |
| 5,142,708 | 9/1992 | Johnson et al. | 4/249 |

*Primary Examiner*—Robert M. Fetsuga

[57] ABSTRACT

A toilet flush actuator for actuating a flush lever of a toilet, the actuator including an elongate stem having an upper end and an a lower end, a component for slideably holding the stem in a substantially vertical orientation, and a component for removably mounting the stem and the holding component at the toilet lever so that the lower end of the stem is engageable with the toilet lever.

12 Claims, 1 Drawing Sheet

TOILET FLUSH ACTUATOR

BACKGROUND OF THE INVENTION

1. Field of the Invention

The present invention relates to the field of water closets or toilets, and more particularly to a device which makes it easier to flush a toilet.

2. Description of the Prior Art

It is commonly known that toilets are generally flushed by depressing a lever which causes the plunger within the tank to open to allow the water in the bowl to drain. A problem with this is that one must be able to access the lever in order to carry out the flushing operation. This can prove to be quite a problem for the elderly, the infirmed, and the handicapped. Additionally, particularly in public rest rooms, the facilities are often in such poor sanitary condition that the user either does not flush in order to avoid contact with the toilet handle or, particularly in the case of a man, uses his foot to actuate the toilet handle.

A great many devices have been developed for assisting in the flushing of a toilet. Two of such devices are disclosed in U.S. Pat. Nos. 2,862,212 and 4,562,601. Both of these devices project out from the tank, parallel to the floor to make it easier to reach the handle while seated on the toilet. The device of U.S. Pat. No. 2,862,212 includes a level pivotally mounted to the bottom of the toilet tank so as to project out next to the toilet seat. This lever is connected to the flush lever by a chain so that upon pushing down on the lever near the seat the flush lever is actuated to flush the toilet. U.S. Pat. No. 4,562,601 is similar in concept but instead of a separately mounted lever, the outwardly projecting lever is mounted directly to the flush lever so as to project out into the area of a individual's elbow while seated on the toilet. The previously discussed devices are generally intended for use by a person who is seated. Devices have also, however, been arranged on the floor so that a user can flush the toilet by pressing down with his or her foot, similar to a gas pedal of a car. Some toilets, which have a water tank that is mounted high overhead on a wall, have a pull cord or chain which is pulled down to flush the bowl. Although an overhead pull cord is convenient, very few modern toilets have overhead water tanks. For various reasons the other types of devices which are operated while standing have not found wide spread use. These reasons include the complexity of the devices as well as their difficulty to operate, for example, the foot pedal actuator requires the operator to step toward the toilet which in many instances might not be possible due to physical limitations of the individual or spatial limitations of the room itself.

SUMMARY OF THE INVENTION

Accordingly, it is an object of the present application to provide a toilet flush actuator that is easy to use while standing and is also of simple, trouble-free construction.

Pursuant to this object, and others which will become apparent hereafter, one aspect of the present invention resides in a toilet flush actuator that projects upwardly from the toilet so as to be within easy reach of the user without requiring the user to move out of his position when using the toilet in a standing position.

In a first embodiment of the invention the actuator includes an elongate handle having an upper end at which a grasping member is mounted, and a second end at which a roller or slide member is provided for engagement with the flush lever of the toilet. The grasping member can have any shape which would assist the user in pushing down on the handle, for example a ball or spherical shape, an arm projecting from the handle at an angle, etc. . . . . The handle is mounted to the top of the tank by a bracket which has a vertically oriented sleeve. The bracket straddles the wall of the tank and is secured by a set screw. The top of the tank can then be placed on the tank with the bracket mounted in place. The handle is mounted in the sleeve of the bracket so that the handle can freely slide vertically therein. The handle passes coaxially through a spring which is also arranged in the sleeve of the bracket. The sleeve is provided with a longitudinally running slot which guides a pin that is fixed to the handle. The pin engages the top of the spring so that pushing down on the handle causes the spring to be compressed. Thus, when downward force on the handle is released the spring pushes the handle upwardly via the pin. The length of the slot determines the distance of travel of the handle. When the handle is pushed down the roller or slide member engages the flush lever and pushes it down to flush the toilet. After the toilet begins to flush and the handle is released by the user, the spring within the sleeve pushes the handle upward which, in turn, allows the flush lever to regain its original position in which the tank refills with water.

In another embodiment of the invention the handle is attached directly to the flush lever by an elastic sleeve which expands to securely surround the flush lever. The lower end of the handle is fixed to the sleeve so as to extend at a right angle to the longitudinal axis of the sleeve.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a partial right-side view of

FIG. 1;

DETAILED DESCRIPTION OF THE PREFERRED EMBODIMENTS

Figure 1:
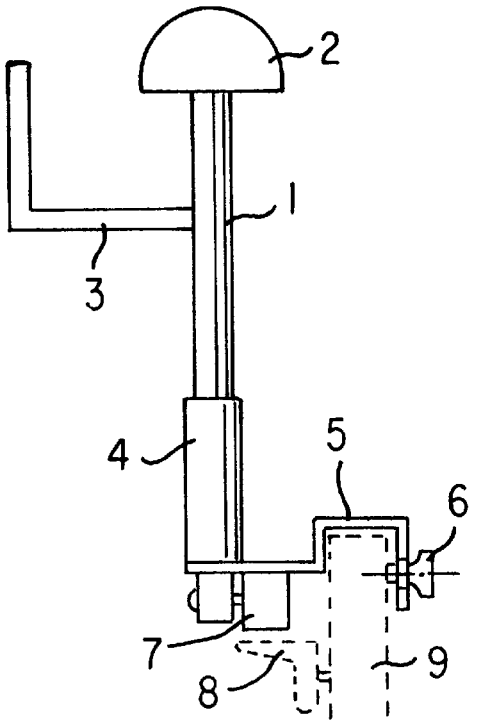
FIG. 1 is a side view of the flush actuator pursuant to the present invention.
Figure 2:
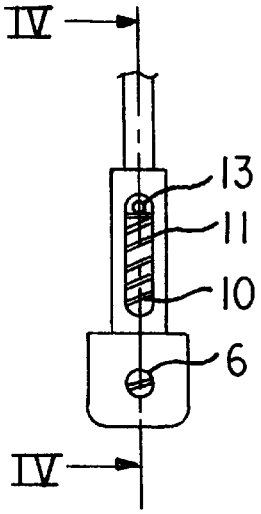
Figure 3:
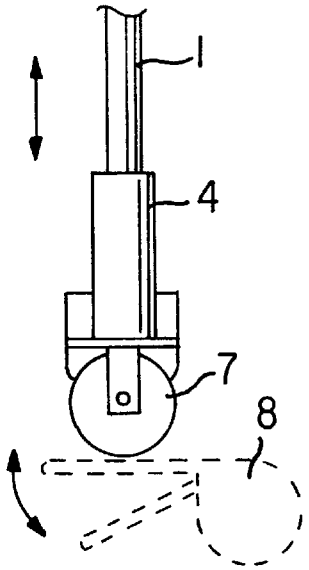
FIG. 3 is a partial left-side view of FIG. 1.
Figure 4:
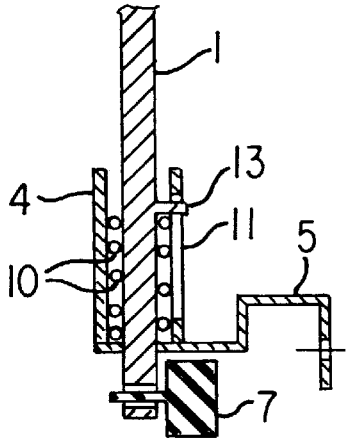
FIG. 4 is a section along the line 4—4 in FIG. 2.

As can be seen in FIG. 1, the inventive toilet flush actuator has a stem 1 on a first end of which a handle member 2 is attached. The handle member 2 can be connected to the end of the stem 1 either removably or permanently. Removably connecting the handle member 2 by, for example a threaded connection, permits interchanging of different types and shapes of handle members as required by different environments and applications. Instead of or in addition to the handle member 2, other extension members 3 project from the stem 1 so as to form a recess which can receive the wrist or forearm of an individual so that the toilet can be flushed by those without the ability to actuate the toilet with their hands.

The stem 1 passes through a sleeve 4 so that the second end of the stem 1 projects from the sleeve 4. An engaging member 7 is attached to the second end of the stem 1 and is preferably in the shape of a wheel whose axis is perpendicular to the longitudinal axis of the stem 1. A bracket 5 has a first end fixed to the end of the sleeve 4 from which the second end of the stem 1 projects. The bracket 5 is shaped so as to hook over the top edge of a toilet tank 9 while still permitting the tank lid 12 to be placed on top of the tank 9. The second end of the bracket 5 has a threaded hole therein through which a set screw 6 can pass. The set screw 6 can be tightened against the inside of the tank 9 so as to secure the bracket 5 and thus the overall device. The bracket 5 is further shaped so as to maintain the sleeve 4 in a substantially vertical orientation. When the bracket 5 is mounted on the tank 9, the engaging member 7 rests on the toilet lever 8.

The sleeve 4 has a longitudinal slot 11 in which a pin 13, that projects orthogonally from the stem 1, slides. The slot 11 and pin 13 serve to limit the travel of the stem 1 through the sleeve 4. A spring 10, such as a coil spring, is arranged in the sleeve 4 so as to be coaxial to the stem 1. One end of the spring 10 engages the pin 13 while the other end of the spring 10 engages the bracket 5 to which the sleeve 4 is connected. The spring 10 serves to keep the pin 13 in its upper limit position against the upper end of the slot 11. As the stem 1 is pushed down against the force of the spring 10, the engaging member 7 pushes down the flush lever 8 of the toilet. Once the flushing action of the toilet begins and the handle member 2 or extension member 3 is released, the spring 10 forces the stem 1 upward which disengages the engaging member 7 from the flush lever 8 of the toilet and allows the toilet tank 9 to refill.

Figure 5:
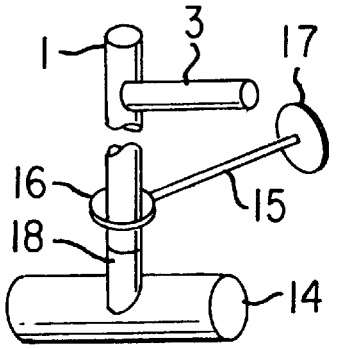
FIG. 5 is a perspective view of another embodiment of the invention.

FIG. 5 shows another embodiment of the invention in which the stem 1 is connected at its lower end with an elastic sleeve 14. The elastic sleeve 14 is well suited for use with toilets that operate with pressurized water. Such toilets generally have a round handle and do not have a tank. Thus, it is not possible to use the first described embodiment of the present invention. In this second embodiment the elastic sleeve 14 stretches to surround the toilet handle and is held in place by the elastic forces of the sleeve 14. The elastic sleeve 14 is also provide with an additional sleeve portion 18 that is molded to the body of the sleeve 14 so as to be perpendicular to the longitudinal axis of the sleeve 14. The additional sleeve portion 18 is dimensioned so that it must be expanded to permit the stem 1 to be placed therein. The elastic force of the additional sleeve portion 18 serves to connect the stem 1 to the elastic sleeve 14 and the elastic sleeve 14 in turn holds the stem 1 on the toilet handle.

In certain situations the elastic sleeve 14, 18 will not sufficiently hold the stem 1 in a vertical orientation. To overcome this problem, a guide member 15 is provided that has one end with an eyelet or through-hole 16 through which the stem 1 can pass. The other end 17 of the guide member 15 is then mounted to the wall of the bathroom by a, for example, a suction cup. The other end 17 of the mounting member 15 can also be mounted to the wall in other way which would be readily apparent to those skilled in the art, for example by gluing or screwing to the wall.

All of the components of the above-described embodiments, with the exception of the elastic sleeve 14, 18, can be made of a variety of different materials based upon cost and manufacturing considerations which provide the desired physical characteristics. For example, the spring 10 can be made of either plastic or metal while the remaining components can be made of plastic, metal or wood.

While the invention has been illustrated and described as embodied in a toilet flush actuator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A toilet flush actuator for actuating a flush lever of a toilet, comprising:

an elongate stem having an upper end and a lower end;

means for slideably holding the stem in a substantially vertical orientation, the holding means including a sleeve member a portion of the stem being slideable in the sleeve member;

means for mounting the stem and the holding means at the toilet lever so that the lower end of the stem is engageable with the toilet lever; and spring means connected between the stem and the sleeve member for opposing downward movement of the stem and maintaining the stem in a first, upper position, the stem being moveable against spring force into a second, lower position in which the toilet lever is actuated.

2. A toilet flush actuator as defined in claim 1, and further comprising a handle member attached to the upper end of the stem, the handle member being configured to facilitate grasping by a hand.

3. A toilet flush actuator as defined in claim 2, and further comprising an extension member attached to the stem so as to project from the stem at an angle.

4. A toilet flush actuator as defined in claim 1, and further comprising an extension member attached to the stem at a distance from the upper and lower ends so as to project from the stem at an angle.

5. A toilet flush actuator as defined in claim 1, wherein the mounting means includes a bracket connected to a lower end of the sleeve member and configured to be engageable with an upper edge of a toilet tank.

6. A toilet flush actuator as defined in claim 5, wherein the bracket is a plate-like member having a first end connected to the lower end of the sleeve member and a second end with an inverted U-shaped configuration which is engageable with the upper edge of the toilet tank.

7. A toilet flush actuator as defined in claim 6, wherein the U-shaped end of the bracket has a outer-most leg that is provided with a threaded through-bore having a central axis perpendicular to the stem, and further comprising a set screw threaded in the through-bore in the outer-most leg.

8. A toilet flush actuator as defined in claim 1, wherein the spring means includes a coil spring arranged in the sleeve member coaxial to the stem.

9. A toilet flush actuator as defined in claim 1, wherein the lower end of the stem projects from a lower end of the sleeve member, and further comprising an engaging member mounted to the lower end of the stem so as to be contactable with the toilet lever, the engaging member being configured to press down the toilet lever in response to a downward force on the stem.

10. A toilet flush actuator as defined in claim 9, wherein the engaging member is shaped as a wheel and is mounted to the stem so that a central axis of the wheel is perpendicular to the stem.

11. A toilet flush actuator for actuating a flush lever of a toilet, comprising:

an elongate stem having an upper end and a lower end;

means for slideably holding the stem in a substantially vertical orientation, the holding means including a sleeve member having a longitudinally running slot with an upper end and a lower end, a portion of the stem being slideable in the sleeve member;

means for mounting the stem and the holding means at the toilet lever so that the lower end of the stem is engageable with the toilet lever;

a pin mounted on the stem so as to project therefrom into the slot; and spring means, arranged in the sleeve member and having a first end engaged with the pin and a second end that contacts the mounting means, for maintaining the stem in a first, upper position in which the pin engages the upper end of the slot, the stem being moveable downward against spring force into a second, lower position in which the pin engages the lower end of the slot.

12. A toilet flush actuator as defined in claim 11, wherein the spring means includes a coil spring arranged in the sleeve member coaxial to the stem.

* * * * *